US008337232B2

(12) United States Patent
Chang

(10) Patent No.: US 8,337,232 B2
(45) Date of Patent: Dec. 25, 2012

(54) ELECTRICAL CONNECTOR HAVING A SHIELDING IN AN OPENING IN ITS BASE

(75) Inventor: Yen-Chih Chang, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/213,104

(22) Filed: Aug. 19, 2011

(65) Prior Publication Data

US 2012/0045908 A1 Feb. 23, 2012

(30) Foreign Application Priority Data

Aug. 20, 2010 (TW) ..... 99216034

(51) Int. Cl.
*H01R 13/625* (2006.01)

(52) U.S. Cl. ..... 439/342

(58) Field of Classification Search ..... 439/258–265, 439/342, 607.35, 55
See application file for complete search history.

(56) References Cited

U.S. PATENT DOCUMENTS 5,357,404 A * 10/1994 Bright et al. ..... 361/818
5,672,844 A * 9/1997 Persson et al. ..... 174/387
6,340,309 B1 * 1/2002 Lin et al. ..... 439/342
6,579,112 B1 * 6/2003 Nobuyuki et al. ..... 439/342
6,692,282 B1 * 2/2004 Ye et al. ..... 439/342
7,317,618 B2 * 1/2008 Robinson et al. ..... 361/719
7,651,358 B2 * 1/2010 Liao ..... 439/342
7,658,634 B2 * 2/2010 Ma ..... 439/342

* cited by examiner

*Primary Examiner* — Chandrika Prasad
(74) *Attorney, Agent, or Firm* — Wei Te Chung; Ming Chieh Chang

(57) ABSTRACT

An electrical connector for electrically connecting a central processing unit (CPU) with a plurality of electronic components assembled thereunder and conductive pins surrounding the electronic components to a printed circuit board (PCB) comprises a base having a plurality of terminals received therein for contacting with the conductive pins of the CPU, a cover mounted on the base, an actuator actuating the cover sliding along the base and a shielding frame mounted on the base. The base has a first opening and a plurality of passageways surrounding the first opening for receiving the terminals. The cover has a second opening corresponding to the first opening. The shielding frame is tightly attached to the sidewalls of the first opening and received in the first and second openings to prevent terminals from electromagnetic interference (EMI) emitted from electronic components assembled under the CPU.

20 Claims, 10 Drawing Sheets

ELECTRICAL CONNECTOR HAVING A SHIELDING IN AN OPENING IN ITS BASE

BACKGROUND OF THE INVENTION

1. Field of the Invention

The present invention relates to an electrical connector for electrically connecting a central processing unit (CPU) to a printed circuit board (PCB), more particularly relates to an electrical connector incorporated with a metallic cage shrouding electromagnetic interference (EMI) emitted from passive devices mounted under the CPU.

2. Description of Related Art

A conventional electrical connector for electrically connecting a central processing unit (CPU) with a plurality of conductive pins to a printed circuit board (PCB) disclosed in U.S. Pat. No. 6,340,309 which is issued to Lin et al. on Jan. 22, 2002 comprises a base having a plurality of terminals received therein, a cover mounted on the base and a driving member driving the cover sliding along the base. The base defines a first opening located at a middle position thereof and a plurality of passageways disposed around the first opening for receiving the terminals. The cover has a second opening corresponding to the first opening of the base and a plurality of through holes for the conductive pins of the CPU passing through. A hollow area is formed by the first and second openings. The electrical connector establishes electrical connection between the CPU and the PCB through the terminals contacting with the conductive pins of the CPU and the terminals being soldered to PCB.

As high-speed input/output and miniaturization requirements, the CPU is required to increase a plurality of electronic components disposed thereunder. The electronic components are received to the hollow area of the electrical connector when the CPU is assembled to the electrical connector. However, electrical signals occurred within the electronic components can produce electromagnetic interference (EMI) affecting electronic signal transmission of the terminals of the electrical connector.

Hence, it is desirable to provide an improved electrical connector to overcome the aforementioned disadvantages.

SUMMARY OF THE INVENTION

Accordingly, an object of the present invention is to provide an electrical connector with a shielding frame to shroud electromagnetic interference (EMI) emitted from electronic components mounted under a central processing unit (CPU).

According to one aspect of the present invention, an electrical connector for electrically connecting a central processing unit (CPU) to a printed circuit board (PCB) comprises a base having a plurality of terminals received therein, a cover mounted on the base, an actuator actuating the cover sliding along the base and a shielding frame attached to the base. The base has a first opening with four sidewalls and a plurality of passageways around the first opening for receiving the terminals. The cover has a second opening corresponding to the first opening. The shielding frame is attached to the sidewalls of the first opening and disposed within the first and second openings to prevent the terminals from electromagnetic interference (EMI) emitted from electronic components assembled under the CPU.

Other objects, advantages and novel features of the invention will become more apparent from the following detailed description when taken in conjunction with the accompanying drawings, in which:

DETAILED DESCRIPTION OF THE INVENTION

Figure 1:
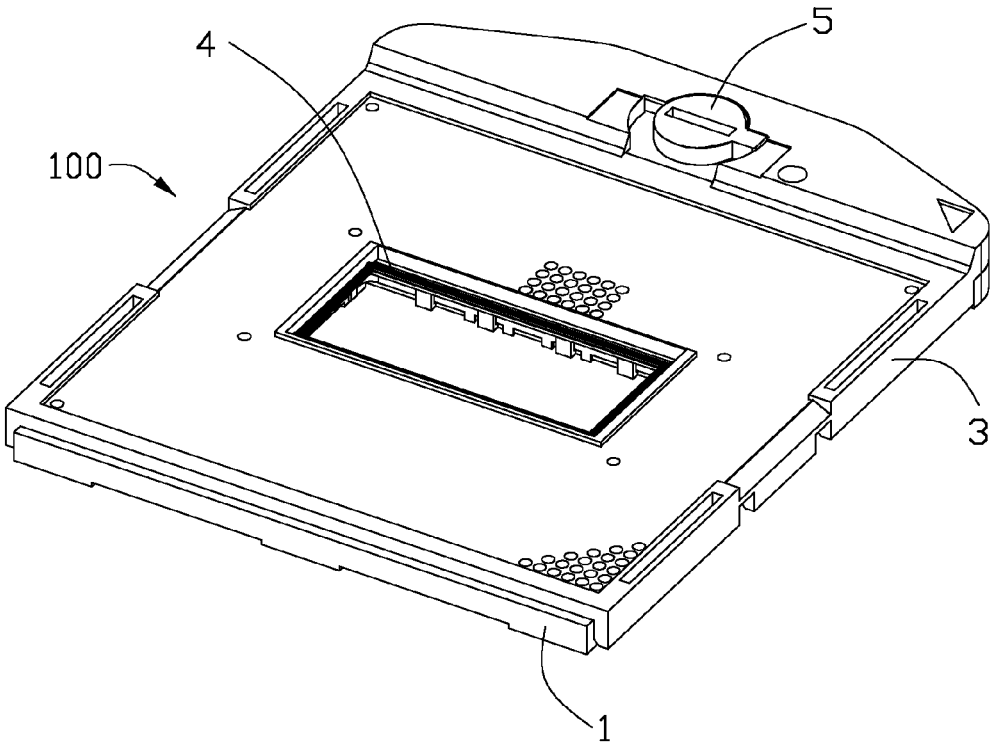
FIG. 1 is a perspective view of an electrical connector in accordance with a first embodiment of the present invention.

Reference will now be made to the drawings to describe the present invention in detail.

FIGS. 1-8 illustrate an electrical connector 100 in accordance with a first embodiment of the present invention for electrically connecting a central processing unit (CPU) 8 having a plurality of electronic components 82 assembled thereunder and a plurality of conductive pins 80 around the electronic components 82 to a printed circuit board (PCB) 9. The electrical connector 100 comprises an insulating housing (not labeled) having a plurality of terminals 2 received therein and a metal shielding frame 4 assembled on the insulating housing (not labeled). The insulating housing includes a base 1 and a cover 3 mounted on the base 1. The shielding frame 4 is mounted on the base 1 to avoid the terminals 2 being affected from EMI produced by electronic components 82 assembled on the CPU 8. The electrical connector 100 also includes an actuator 5 driving the cover 3 sliding along the base 1, an anti-rotation mechanism 6 sandwiched between the base 1 and the cover 3, and a washer 7 engaging with the actuator 5.

Figure 2:
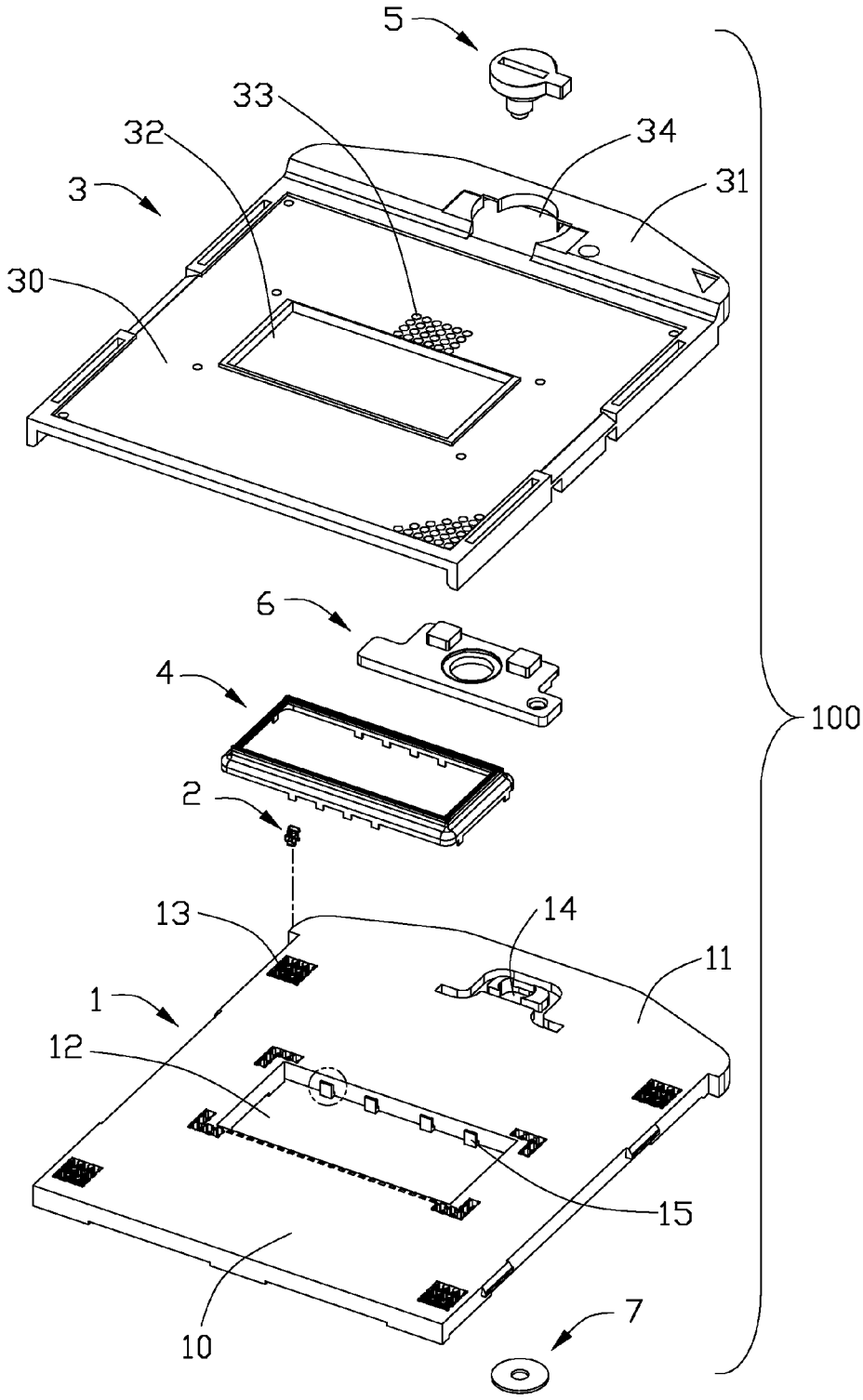
FIG. 2 is an exploded, perspective view of the electrical connector shown in FIG. 1.
Figure 3:
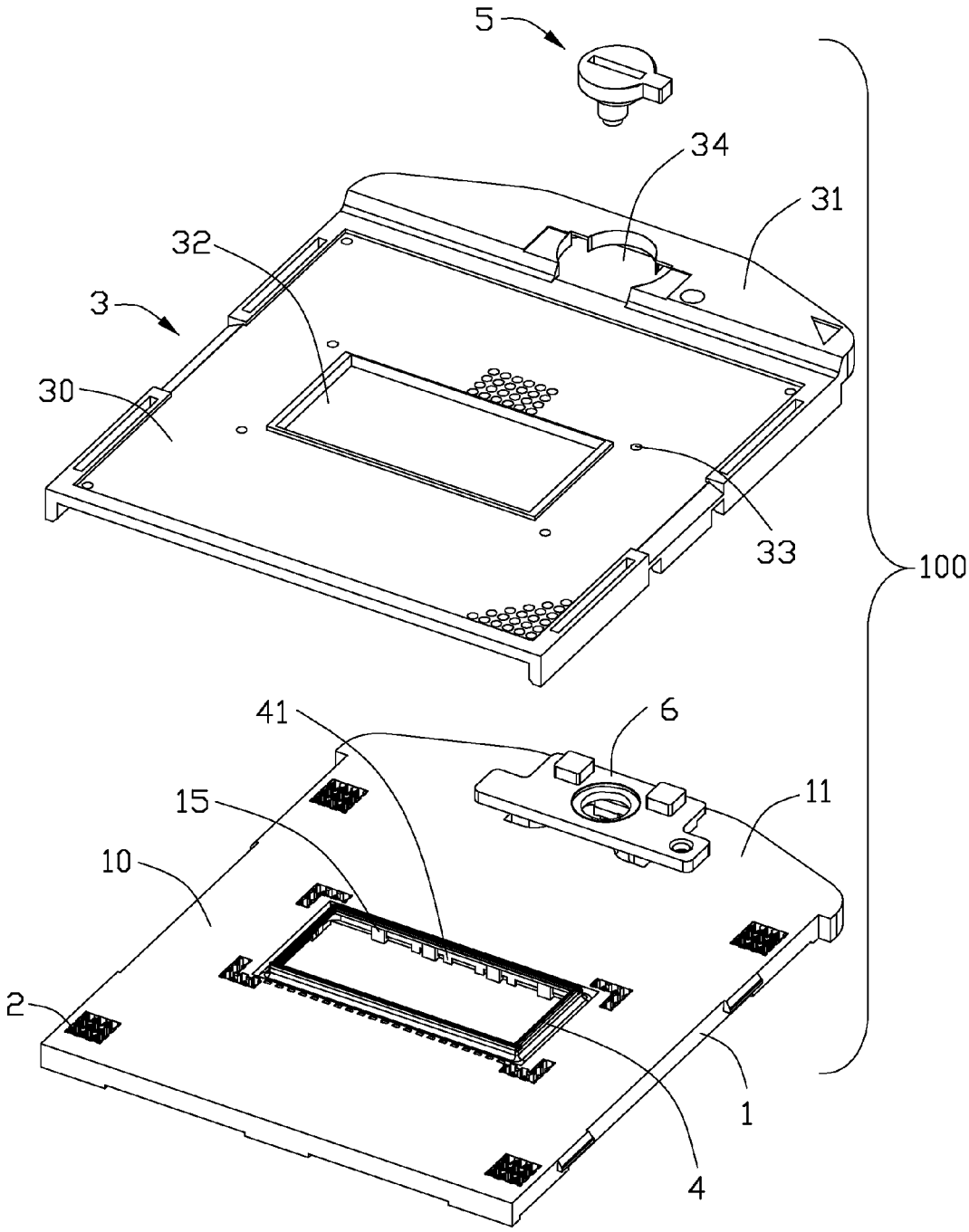
FIG. 3 is similar with FIG. 2, showing a shielding frame assembled on a base of the electrical connector.
Figure 4:
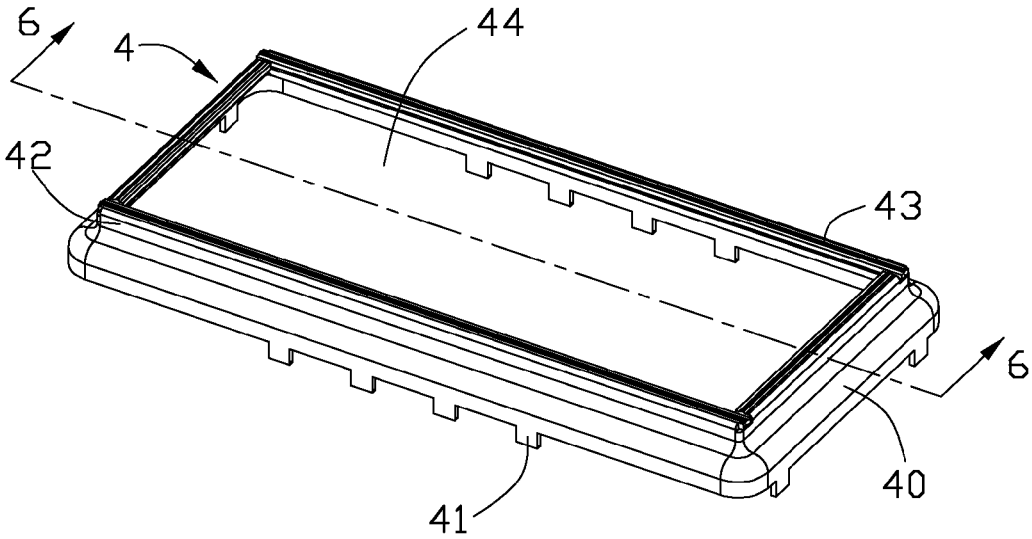
FIG. 4 is a perspective view of the shielding frame of the electrical connector shown in FIG. 2.
Figure 5:
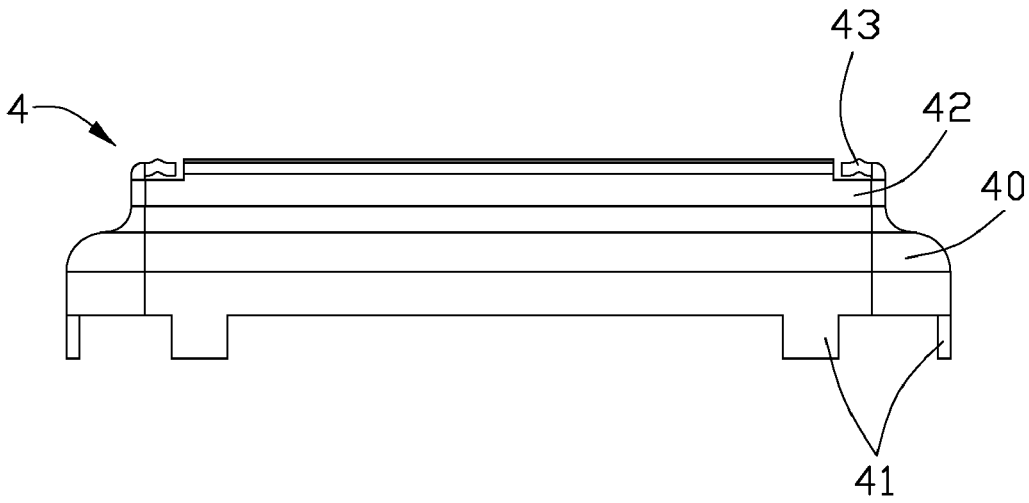
FIG. 5 is a front view of the shielding frame of the electrical connector showing in FIG. 4.
Figure 6:
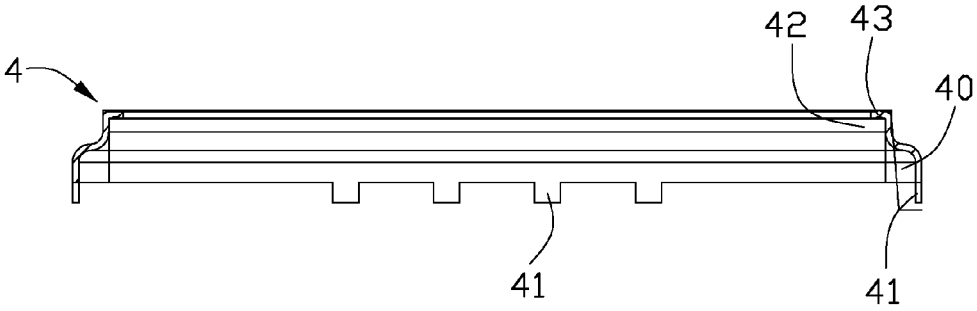
FIG. 6 is a cross-sectional view of the shielding frame of the electrical connector, taken along line 6-6 of FIG. 4.
Figure 7:
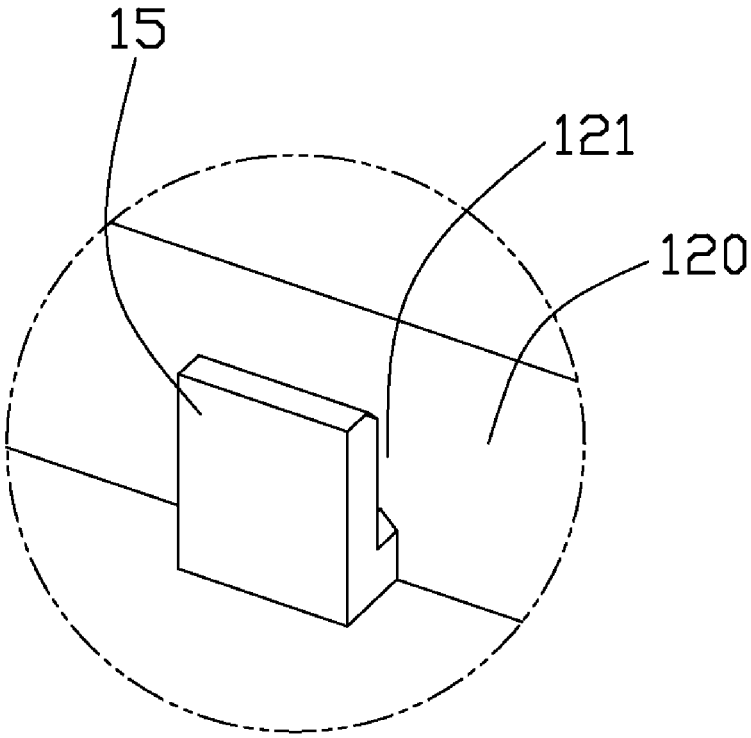
FIG. 7 is an enlarged view of circular portion showing in FIG. 2.
Figure 8:
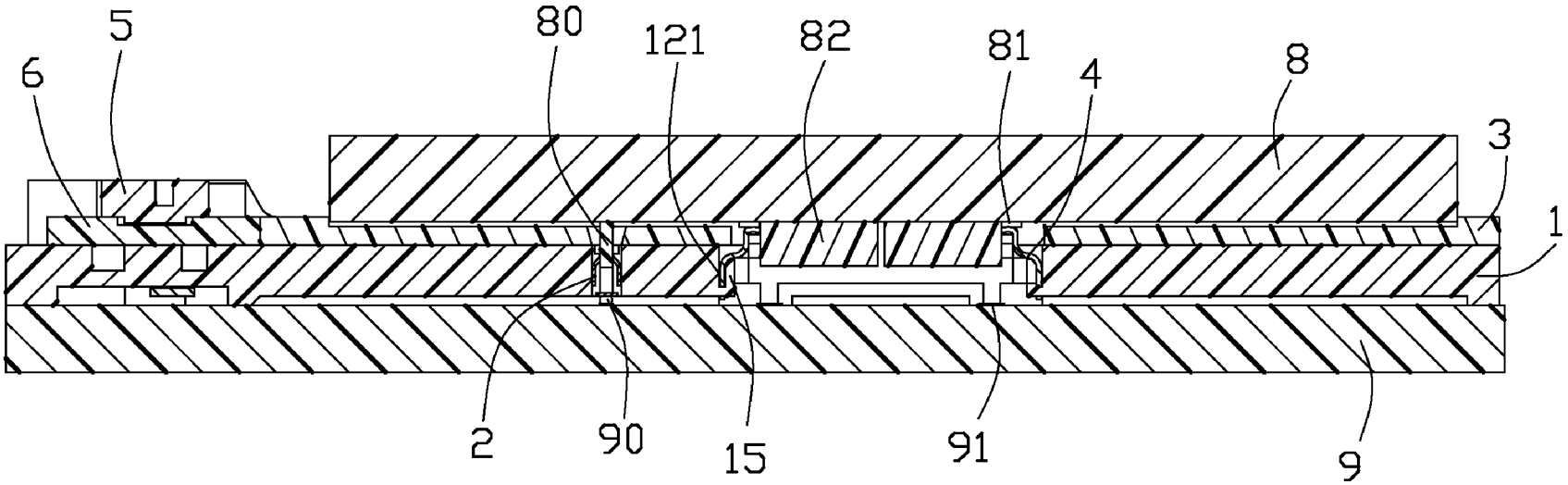
FIG. 8 is a sketch view of the electrical connector of FIG. 1 establishing electrical connection between a CPU and a PCB.

Referring to FIGS. 2 and 3, the base 1 has a plate-like main portion 10 and a first head portion 11 extending from one end of the main portion 10. The main portion 10 defines a first opening 12 located at a middle portion thereof and a plurality of passageways 13 surrounding the first opening 12 for receiving the terminals 2. The first head portion 11 defines a first recess 14 for receiving corresponding parts of the actuator 5. The first opening 12 has four sidewalls 120 and a plurality of holding portions 15 extending from the sidewalls 120 toward the first opening 12. The holding portions 15 each bent upwardly from a bottom edge of the sidewalls 120 for engaging with the shielding frame 4. A plurality of receiving slots 121 are formed between the holding portions 15 and the corresponding sidewalls 120.

The cover 3 includes a supporting portion 30 corresponding to the main portion 10 of the base 1 and a second head portion 31 corresponding to the first head portion 11 of the base 1. The supporting portion 30 defines a second opening 32 corresponding to the first opening 12 for receiving the shielding frame 4 and a plurality of through holes 33 corresponding to the passageways 13 for allowing conductive pins 80 of the CPU 8 to be passed through. The second recess 34 is formed on the second head portion 31 for receiving corresponding parts of the actuator 5. The insulating housing (not labeled) has a window (not labeled) jointly formed by the first opening 12 of the base 1 and the second opening 32 of the cover 3.

Referring to FIGS. 2 to 7, the shielding frame 4 has a size approximately same with that of the first opening 12 of the base 1 and includes four sidewalls 40 received in the receiving slots 121 of the base 1 and a third opening 44 surrounded by the sidewalls 40 for receiving the electronic components 82 assembled under the CPU 8. Each sidewall 40 defines at least one tab 41 extending downwardly from a bottom edge thereof and a protruding portion 42 extending upwardly from an inner edge thereof. The tabs 41 extend beyond a bottom of the base 1 to engage with ground points 91 of the PCB 9. Each protruding portion 42 has a plurality of ribs 43 disposed at a top portion thereof. The ribs 43 has a top edge located beyond a top surface of the cover 3 and contacting with ground pads 81 of the CPU 8. The sidewalls 40 are tightly attached to the sidewalls 120 of the base 1 and held by the holding portions 15. The sidewalls 40 vertical to a sliding direction of the cover 3 relative to the base 1 each has an outer surface distanced from that of the corresponding protruding portion 42 to prevent the cover 3 from knocking against the protruding portions 42 during the cover 3 moves along the base 1.

The electrical connector 100 establishes electrical connection between the CPU 8 and the PCB 9 through the terminals 2 contacting with conductive pins 80 of the CPU 8 and being soldered to conductive points 90 of the PCB 9. The electrical connector 100 prevents the terminals 2 from electromagnetic interference (EMI) produced by the electronic components 82 disposed at a bottom of the CPU 8 through the ribs 43 of the shielding frame 4 contacting with the ground pads 81 of the CPU 8 and the tabs 41 of the shielding frame 4 being soldered to the ground points 91 of the PCB 9, so as to ensure reliable electrical connection between the CPU 8 and the PCB 9.

Figure 9:
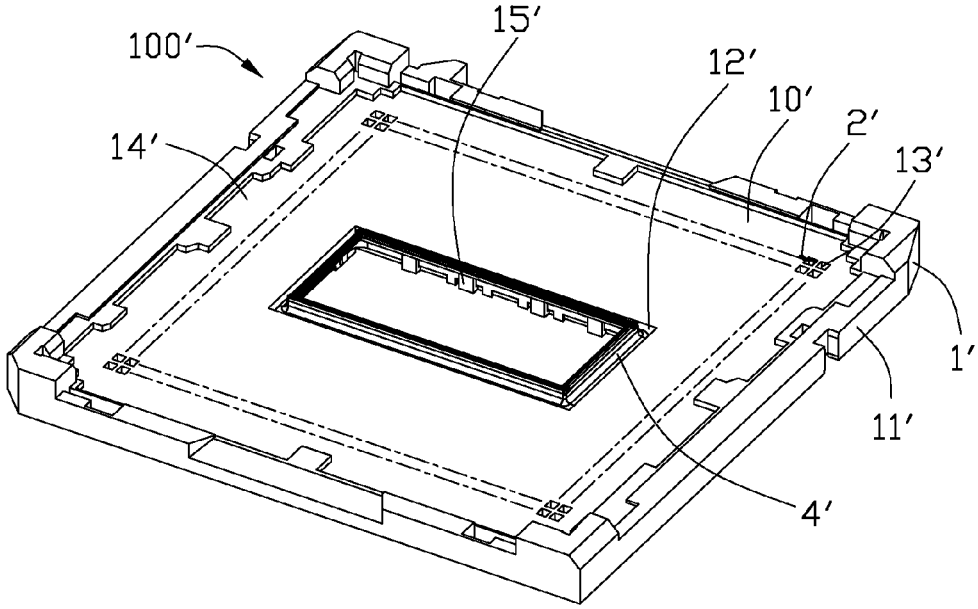
FIG. 9 is a perspective view of an electrical connector in accordance with a second embodiment of the present invention.
Figure 10:
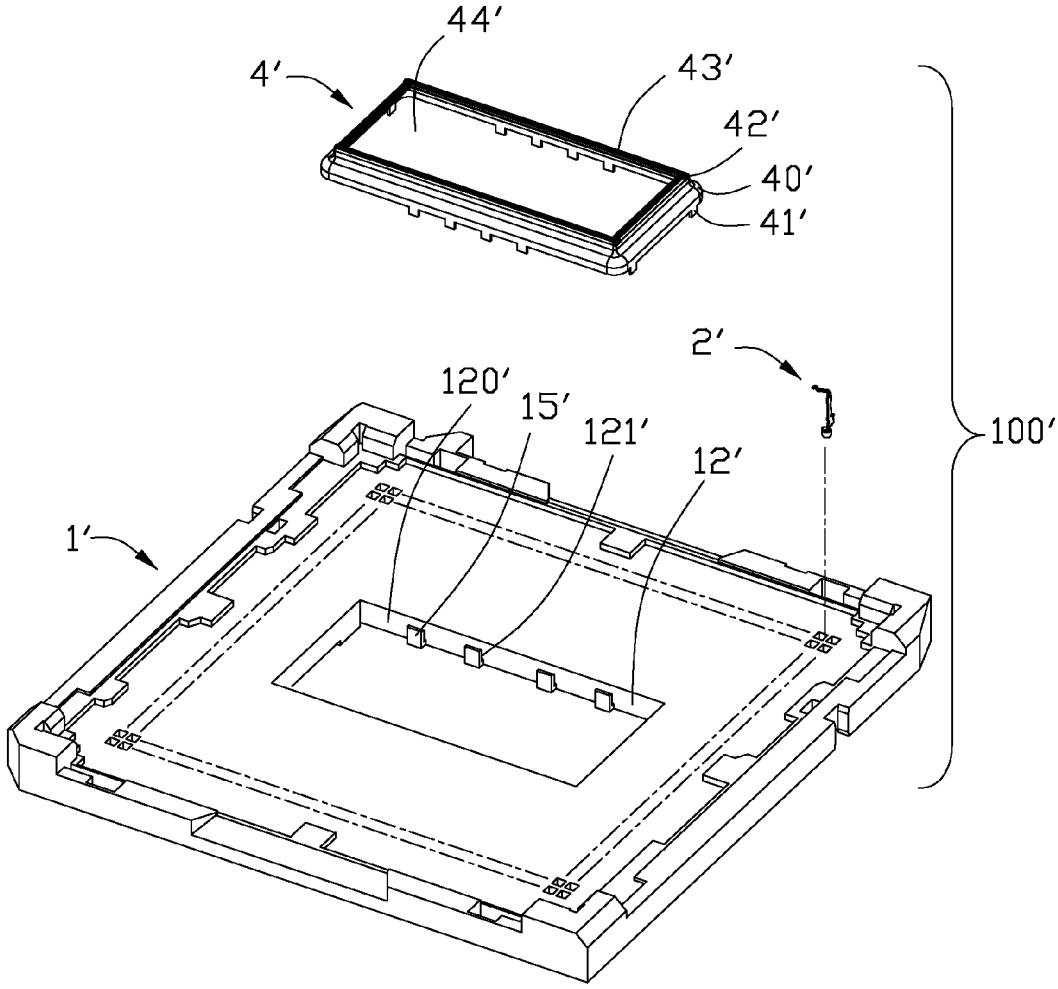
FIG. 10 is an exploded, perspective view of the electrical connector shown in FIG. 9.

Referring to FIGS. 9 to 10, an electrical connector 100' in accordance with a second embodiment of the present invention for electrically connecting a central processing unit (CPU) (not shown) having a plurality of electronic components disposed thereunder and a plurality of conductive pad around the electronic components to a printed circuit board (PCB) (not shown) comprises an insulative housing 1' having a plurality of terminals 2' received therein and a metal shielding frame 4' assembled to the insulative housing V. The insulative housing 1' includes a base body 10' and four sidewalls 11' around the base body 10'. The base body 10' has an aperture 12' disposed at a middle portion thereof and a plurality of passageways 13' around the aperture 12' for receiving the terminals 2'. A receiving space 14' is defined by the base body 10' and the sidewalls 11' for receiving the CPU (not shown). The aperture 12' has four sidewalls 120' and a plurality of holding portions 15' extending from the sidewalls 120' toward the aperture 12'. The holding portions 15' each bent upwardly from a bottom edge of the sidewalls 120' for engaging with the shielding frame 4'. A plurality of receiving slots 121' are formed between the holding portions 15' and the corresponding sidewalls 120'.

The shielding frame 4' is mounted within the aperture 12' for prevent the terminals 2' from electromagnetic interference (EMI) produced by the electronic components disposed at a bottom of the CPU and has a size approximately same with that of the aperture 12' of the insulative housing 1'. The shielding frame 4' includes four sidewalls 40' received in the receiving slots 121' of the insulative housing 1' and an opening 44' surrounded by the sidewalls 40' for receiving the electronic components assembled under the CPU. Each sidewall 40' defines at least one tab 41' extending downwardly from a bottom edge thereof and a protruding portion 42' extending upwardly from an inner edge thereof. The tabs 41' extend beyond a bottom of the insulative housing 1' to engage with ground points of the PCB (not shown). Each protruding portion 42' has a plurality of ribs 43' disposed at a top portion thereof. The rib 43' has a top edge located beyond a top surface of the base body 10' and contacting with ground pads of the CPU (not shown). The sidewalls 40' are tightly attached to the sidewalls 120' of the insulative housing 1' and held by the holding portions 15'.

The electrical connector 100' establishes electrical connection between the CPU and the PCB through the terminals 2' contacting with the conductive pads of the CPU and being soldered to the conductive points of the PCB. The electrical connector 100' prevents the terminals 2' from electromagnetic interference (EMI) produced by the electronic components disposed at a bottom of the CPU through the ribs 43' of the shielding frame 4' contacting with the ground pads of the CPU and the tabs 41' of the shielding frame 4' being soldered to the ground points of the PCB, so as to ensure reliable electrical connection between the CPU and the PCB.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting a central processing unit (CPU) to a printed circuit board (PCB) comprising:

a base having a first opening with four sidewalls and a plurality of passageways around the first opening;

a plurality of terminals received in the corresponding passageways;

a cover mounted on the base and having a second opening corresponding to the first opening of the base;

an actuator driving the cover sliding along the base; and a shielding frame disposed within the first opening of the base.

2. The electrical connector as claimed in claim 1, wherein the shielding frame is attached to the sidewalls of first opening, wherein the base has a plurality of holding portions extending from the sidewalls to hold the shielding frame, and wherein a plurality of receiving slots are formed between the holding portions and the corresponding sidewalls to receive the sidewall of the shielding frame.

3. The electrical connector as claimed in claim 2, wherein each holding portion extend upwardly from the sidewall and is located in the first opening.

4. The electrical connector as claimed in claim 1, wherein the shielding frame defines a plurality of tabs extending downwardly therefrom, and wherein the tabs extend beyond a bottom surface of the base.

5. The electrical connector as claimed in claim 4, wherein the shielding frame has a plurality of protruding portions extending upwardly therefrom, and wherein the protruding portions are received in the second opening of the cover and extend beyond a top surface of the cover.

6. The electrical connector as claimed in claim 5, wherein the shielding frame has four sidewalls and a third opening surrounded by the sidewalls, and wherein the protruding portions each extends upwardly from an inner edge of the corresponding sidewall, and wherein the sidewalls vertical to a sliding direction of the cover relative to the base each has an outer surface distanced from that of the corresponding protruding portion to prevent the cover from knocking against the protruding portions during the cover moves along the base.

7. The electrical connector as claimed in claim 5, wherein the shielding frame has a plurality of ribs disposed at top portions of the protruding portions.

8. The electrical connector as claimed in claim 1, wherein the shielding frame has a size slightly less than that of the first opening of the base.

9. An electrical connector for electrically connecting a central processing unit (CPU) to a printed circuit board (PCB) comprising:

an insulating housing having a window and a plurality of passageways around the window;

a plurality of terminals arranged in the corresponding passageways; and a shielding frame disposed within the window to prevent the terminals from electromagnetic interference (EMI) emitted from electronic components assembled under the CPU.

10. The electrical connector as claimed in claim 9, wherein the insulating housing has a plurality of holding portions extending from the sidewalls of the window to hold the shielding frame.

11. The electrical connector as claimed in claim 10, wherein the insulating housing has a plurality of receiving slots formed between the holding portions and the sidewalls for receiving the sidewalls of the shielding frame.

12. The electrical connector as claimed in claim 11, wherein the holding portions extend upwardly from bottom portions of the sidewalls and engage with the shielding frame to assemble the shielding frame on the insulating housing.

13. The electrical connector as claimed in claim 9, wherein the shielding frame has a plurality of tabs extending downwardly therefrom, and wherein the tabs extend beyond a bottom of the insulating housing.

14. The electrical connector as claimed in claim 9, wherein the shielding frame has a plurality of protruding portions extending upwardly therefrom, and wherein the protruding portions extend beyond a top of the insulating housing.

15. The electrical connector as claimed in claim 14, wherein the shielding frame defines a plurality of ribs disposed at top portions of the protruding portions.

16. The electrical connector as claimed in claim 9, wherein the shielding frame has a size slightly less than that of the window of the insulating housing.

17. An electrical connector assembly comprising:

a printed circuit board defining thereon a connector mounting area surrounding a component mounting area;

an insulative housing mounted upon the connector mounting area and defining a center opening which is aligned with the component mounting area and surrounded by a contact receiving portion equipped with a plurality of contacts therein; and a metallic shell received in the center opening and shielding the component mounting area at least vertically.

18. The electrical connector assembly as claimed in claim 17, wherein the housing includes a lower stationary base and an upper moveable cover which is back and forth moveable relative to the base in a front-to-back direction.

19. The electrical connector assembly as claimed in claim 18, wherein the shield is attached to at least one of the cover and the base.

20. The electrical connector assembly as claimed in claim 18, wherein the shield defines a plurality of tabs mounted to the printed circuit board.

* * * * *